US007815463B2

(12) United States Patent
Gerberding

(10) Patent No.: US 7,815,463 B2
(45) Date of Patent: Oct. 19, 2010

(54) SPRING FORCE CONNECTOR

(75) Inventor: Wofgang Gerberding, Hessisch-Oldendorf (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 43 days.

(21) Appl. No.: 12/259,735

(22) Filed: Oct. 28, 2008

(65) Prior Publication Data

US 2009/0124139 A1 May 14, 2009

(30) Foreign Application Priority Data

Oct. 29, 2007 (DE) ..... 10 2007 051 900

(51) Int. Cl.
*H01R 11/20* (2006.01)

(52) U.S. Cl. ..... 439/441; 439/828

(58) Field of Classification Search ..... 439/438–441, 439/654, 828, 834–835
See application file for complete search history.

(56) References Cited

U.S. PATENT DOCUMENTS

| | | | | |
|---|---|---|---|---|
| 4,728,295 | A | 3/1988 | Henrici et al. | |
| 5,816,867 | A * | 10/1998 | Davidsz et al. | 439/828 |
| 6,183,311 | B1 * | 2/2001 | Suess et al. | 439/716 |
| 7,607,956 | B2 * | 10/2009 | Lang et al. | 439/835 |

FOREIGN PATENT DOCUMENTS

| | | | |
|---|---|---|---|
| DE | 195 11 655 | A1 | 3/1995 |
| DE | 199 49 387 | A1 | 10/1999 |
| DE | 200 13 439 | U1 | 8/2000 |
| DE | 10 2004 030 440 | B4 | 6/2004 |
| DE | 20 2005 014 510 | U1 | 5/2006 |
| DE | 10 2005 001 821 | A1 | 7/2006 |
| EP | 1 622 224 | A1 | 7/2006 |

* cited by examiner

*Primary Examiner*—Edwin A. Leon
*Assistant Examiner*—Vaneesa Girardi
(74) *Attorney, Agent, or Firm*—Whitham Curtis Christofferson & Cook, PC

(57) ABSTRACT

A spring-force connection with a current rail piece with at least two mutually independent clamping points which interact with in each case one spring end for clamping electrical conductors is described. The current rail piece has on both sides of a center piece two end pieces bent away in each case from the center piece, the interior angle of which end pieces is located in the bending area on the same top of the current rail piece. The end pieces in each case have conductor through-openings into which associated clamping springs are inserted, wherein the clamping springs are supported with one clamping spring end on the current rail piece and, in the conductor-less inoperative state rest with the other clamping spring end on a clamping point formed at the associated conductor through-opening.

19 Claims, 6 Drawing Sheets

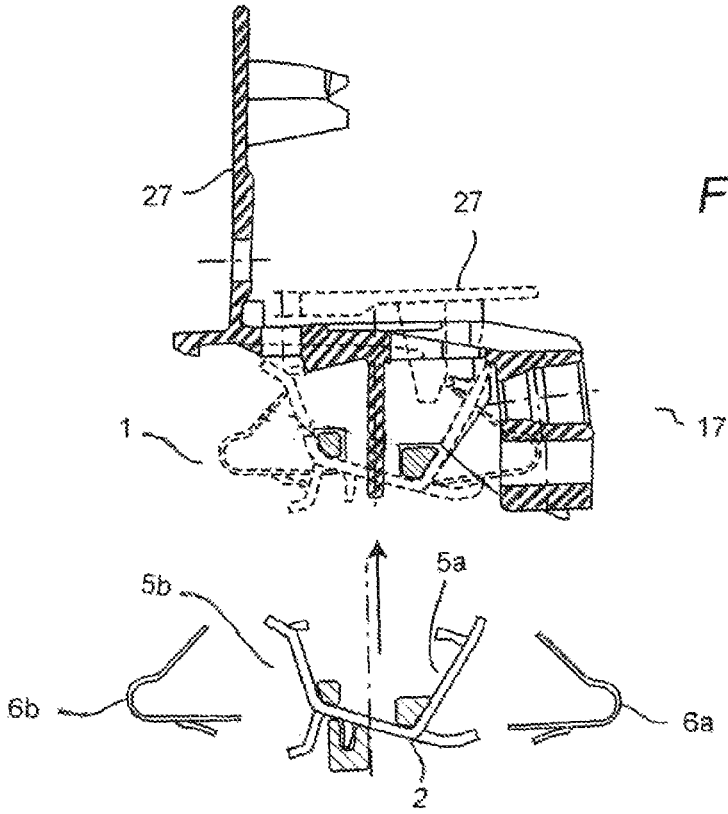
Figure 12
Figure 13
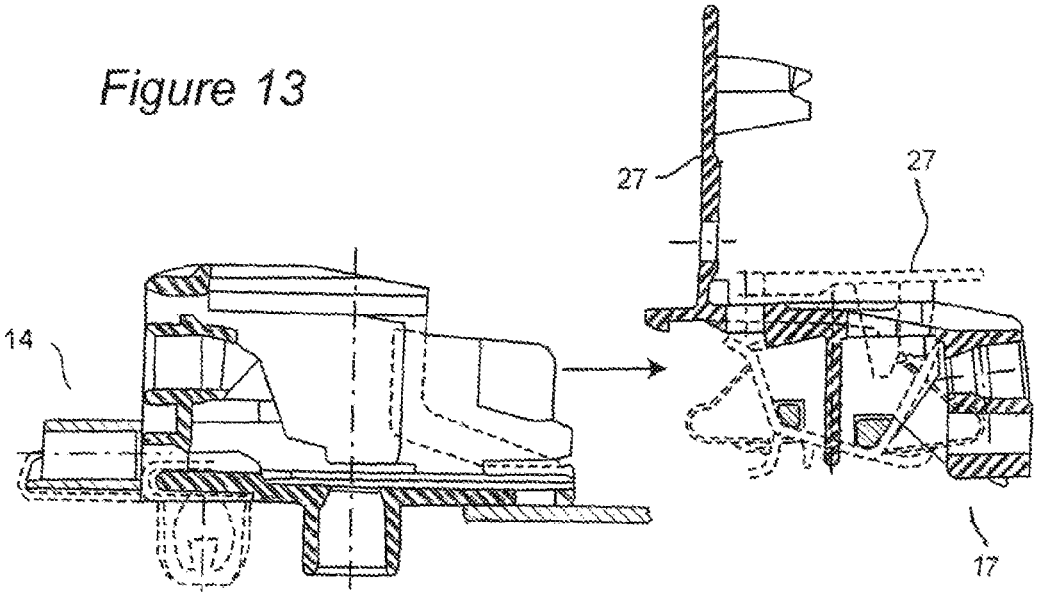

SPRING FORCE CONNECTOR

BACKGROUND OF THE INVENTION

1. Field of the Invention

The invention relates to a spring-force connection with a current rail piece with two mutually independent clamping points which interact with in each case one spring end for clamping electrical conductors. The current rail piece has on both sides of a center piece two mutually opposite end pieces in each case bent away from the center piece, the interior angle of which end pieces is located on the same surface of the rail piece in the bending area. The end pieces in each case have conductor through-openings into which associated clamping springs are inserted, the clamping springs being supported with one clamping spring end on the current rail piece and resting in the conductorless unoperated state with the other clamping spring end on a clamping point formed at the associated conductor through-opening.

The invention also relates to a conductor connecting terminal, for example a series terminal, a connection terminal, an electronics module terminal or the like, with a housing of insulating material and at least one such spring-force connection in the housing of insulating material.

2. Description of the Related Art

Spring-force connections are used in various forms in terminals in order to contact electrical conductors screwlessly by means of spring force. For example, such spring-force connections are used in terminals which are locked into a housing panel of the lamp in order to connect the lamp with connecting lines.

DE 2004 030 440 B4 discloses a lamp connecting terminal with three parallel plug contacts in a housing of insulating material on the top of a support plate and connecting contacts protruding on the underside of the support plate which are electrically connected to the plug contacts.

DE 10 2005 001 821 describes an electrical equipment connection with a connecting terminal arranged in an equipment housing, into which clamping contacts are integrated in a similar manner which can be activated by means of an operating lever. The connecting terminal has attachment domes, protruding through the equipment housing plate, with mounting lugs molded elastically thereon and plug contact receiving channels in the mounting domes in order to receive selected plug contacts of a plug connector.

U.S. Pat. No. 4,728,295 A discloses a connector block in which two opposite conductor insertion openings are provided in a housing of insulating material into which a bent current rail piece with an inserted clamping spring is integrated. While on one side adjoining a conductor insertion opening the clamping spring can be activated via an operating pusher and forms a detachable clamping point for an inserted conductor, a flexible leg of the contact spring lies adjoining the opposite conductor insertion opening, against the current rail in order to form a further clamping point. One end of the current rail piece adjoins a bent connecting contact rail which has a contact loop bent in a U shape, protruding below the bottom part of the housing of insulating material, which loop forms a plug contact.

SUMMARY OF THE INVENTION

On the basis of this, it is the object of the present invention to create an improved spring-force connection with at least two clamping points and a conductor connection and connecting terminal with such a spring-force connection.

The object is achieved by means of the spring-force connection of the type initially mentioned, in that the clamping points are arranged oppositely to the center piece so that a conductor inserted into a conductor through-opening is located between center piece and clamping point.

Such a spring-force connection with current rail piece bent away on both sides in the same direction and clamping springs inserted on both sides into the end pieces bent away, in which the clamping points are arranged oppositely to the center piece so that a conductor inserted into a conductor through-opening lies between center piece and clamping point, has the advantage that it forms a self-supporting construction and requires little use of material. There are no transverse bends on the same surface, which results in a saving of material. By means of this construction, at least two oppositely located clamping points are implemented which offer sufficient free space to the center piece in order to provide further contact points. The spring-force connection can also be optimally installed in a housing of insulating material so that a conductor stop, a lateral conductor guide and conductor bundling, an upper closed conductor well for maintaining leakage and air paths and an inner conical conductor guide is provided.

To form the current rail piece, preferably a metal plate of well-conducting material, particularly of copper, is machined with stamping tools. In this context, it is particularly advantageous if on both sides at the end pieces in the upper area, material tabs which are bent over pointing towards one another, pointing in the same direction or pointing away from one another and form a support bearing for conductor ends pushed into the clamping points are stamped out during the formation of the conductor through-openings of the end pieces. The clamping spring ends resting on the clamping point then rest on the material tabs under pretension or simply only on a transverse edge of the conductor through-opening. The material tabs create the possibility of contacting both rigid and flexible conductors. In addition, the variation of force can be optimized and the installation of operating pushers is made possible due to the greater degrees of design freedom.

Furthermore, it is advantageous if a support point for a clamping spring end is formed at least one of the conductor through-openings, also by stamping out a support tab which is bent out of the conductor through-opening oppositely to the direction of extent of the center piece of the current rail piece and has a stop for a clamping spring. This at least one support tab is located opposite to the clamping point of a conductor through-opening.

In the lower clamping spring area adjoining the center piece, a special direct plug connection which can be used, for example, for a lamp connecting terminal for creating a connecting capability for a PE contact or for a capacitor can be created. In this context, the support tabs provide a further clamping point in conjunction with a contact tab bent away from the clamping spring in the direction of the support tab. The same clamping spring can also be used on the opposite side of the direct connection for saving spring tool and simplifying the assembly machine not in conjunction with a direct plug connection. In this arrangement, the support tabs form a bearing for supporting and mounting the clamping springs and act in a stabilizing manner for the direct plug connection provided in the lower area of the spring-force connection adjoining the center piece, with its different directions of load.

For this purpose, the support tab preferably has a sill or indentation on which the locking tab bent away from the clamping spring is supported at the support spring end. The support spring end which is not bent away, in contrast, rests on the support area of the support tab extending to the sill or in the direction of the conductor through-opening.

The support tab can be located on one plane with the center piece of the current rail piece so that the support tab is not bent over with respect to the center piece. Instead, only the end piece is bent away upward after the stamping-out of the support tab and, if necessary, only the end of the support tab is slightly bent away to form the clamping point.

It is also advantageous if a support tab is bent out of the plane of the center piece of the current rail piece oppositely to the adjoining end piece of the current rail piece and a through-opening is stamped out of this bent out support tab. This creates a clamping point if the clamping spring end of an associated clamping spring extends through the through-opening and is supported against the center piece. From the clamping spring, a contact tab is stamped out which is bent away towards the end of the through-opening for electrically contacting a conductor end which can be pushed through the through-opening in the support tab, which is opposite the center piece.

However, the end of a support tab can also be bent up in the direction of the clamping leg of the associated clamping spring in order to support the clamping spring. In this arrangement, the free end of the support tab preferably rests at the clamping leg in an area immediately adjoining the spring arc adjoining the clamping leg, i.e. at the end of the clamping leg.

In the center piece of the current rail piece, a contact cutout can be provided, particularly for use of the spring-force connection in lamp connecting terminals, which is provided for receiving an elastic contact pin coming into electrical contact with the contact cutout, particularly at the narrow edge of the contact cutout, i.e. the transverse edge transversely to the longitudinal direction of the center piece. In this manner, a contact pin (contact plug) can be inserted into the current rail piece from below transversely to the direction of insertion of the conductors which can be clamped at the main clamping points with the clamping springs. It is advantageous if a contact tab, which comes in contact with a contact pin to be inserted into the contact cutout and which is bent out of the plane of the center piece, is provided at least one of the narrow ends of the contact cutout. The contact tab forms a conductor stop for the direct plug connection and a contact point for the contact pin. Due to an oblique extent of the contact tab, the contact points are approximately oppositely located. In addition, a force-storing function for an elastic PE contact which can be plugged into the contact cutout can be produced by the contact tab. The spring-force connection described above can be installed in various ways into electrical equipment and particularly into conductor connecting and connection terminals.

It is particularly advantageous in this context if the housing of insulating material of the conductor connecting terminal is constructed in two parts of a bottom part and a lid part which can be locked into the bottom part by means of plug-in locking connection. Due to this construction in two parts, automatable assembly is possible in that the spring-force connection, for example, is first inserted into the lid part and then the bottom part is placed onto the lid part and is locked to the latter. Due to the assembly transversely to the direction of conductor insertion into the lid, the inner conductor stop and the guidance area can be implemented in a simple manner wherein the inner area can be designed with a partition wall.

The bottom part and the lid part are arranged to be L-shaped in section and have conductor insertion openings in the front section going away transversely in the direction of the lid part from a bottom section of the bottom part and in the front section going away transversely in the direction of the bottom part from a lid section of the lid part, which are aligned with the conductor through-openings at the end pieces of the spring-force connections inserted into the lid part and fixed by the bottom part introduced into the lid part in the direction of the front section of the lid part.

The front sections of the bottom and lid parts, which are L-shaped in longitudinal section, thus carry the conductor insertion opening which is oriented towards the clamping points.

At the end of the at least one conductor insertion opening in the lid section of the lid part, an inside angle is preferably formed by forming a step in order to receive an end of the current rail piece in the inside angle to facilitate assembly. In conjunction with corresponding steps on the opposite side in the bottom part, it is possible to position the current rail piece in the housing of insulating material.

The lid section of the lid part preferably has an operating pusher molded in articulated manner on the lid section, with an operating finger extending through the lid section in the direction of the bottom section of the bottom part. This operating finger interacts with in each case one clamping spring of the at least one spring-force connection in such a manner that the clamping spring is operated when the operating pusher is pushed down in the direction of the bottom section of the bottom part.

In particular, an operating pusher can have several operating fingers which are arranged parallel to one another in order to simultaneously operate the clamping springs of several spring-force connections arranged parallel to one another. However, it is also possible to provide in each case one operating pusher per spring-force connection.

Furthermore, it is advantageous if a partition wall formed integrally with the lid section of insulating material, which extends from the lid section in the direction of the bottom section at least to the center piece of the at least one spring-force connection and is used as conductor stop and for stabilizing the inner lid contour. By means of the partition wall, the conductor receiving chambers adjoining opposite conductor insertion openings are then delimited from one another in the housing of insulating material.

In the transition of the front section of the bottom part to the bottom section, a conductor insertion opening can also be provided in each case which is oriented towards a clamping point formed below a clamping spring of the spring-force connection. Into the conductor insertion opening in the area of the bottom section, almost any type of conductor or conductor-like parts can be inserted such as, for example, separate PE connecting contacts or the connecting tabs of capacitors. The bottom section should then be raised in the direction of the lid part in the area of the conductor insertion opening so that, for example, a PE connecting contact can be electrically connected to a spring-force connection through the conductor insertion opening. The PE connecting contact is conducted by the clamping point with the spring-force connection initially above the bottom section and bent over in the area of the front in order to be conducted around below the bottom section in the raised area. The PE connecting contact then rests on the bottom section in the raised area and protrudes for connection with an equipment housing, particularly with a lamp plate. In this arrangement, the PE contact can be arbitrarily positioned. In particular, it is not necessary that the PE contact is located flush with central clamping points oriented towards the center piece of the rail.

Furthermore, the conductor connecting terminal preferably has at least one clamp dome protruding from the bottom section. Into the clamp domes, plug-in contact receiving ducts are in each case inserted which are flush with associated contact cutoutes in the center piece of the spring-force connection. By this means, contact pins can be inserted into the plug-in contact receiving duct and electrically connected to the current rail piece at the contact cutoutes, the contact pins being electrically insulated in the area of the insertion point with the aid of the clamp domes. This is the case, particularly when the conductor connecting terminal is installed as lamp connecting terminal in a lamp plate and electrical contacting of the contact pins with the lamp connecting plate must be avoided for the active current paths.

Furthermore, it is advantageous if the terminal is provided on the underside of the bottom section in a manner known per se with spring locking noses for locking the conductor connecting terminal to an equipment housing plate. Thus, the clamping domes can be used not only for providing a well for the contact pins which is insulated on all sides but also for fixing the conductor connecting terminal to an equipment housing plate.

Optionally, a PE connecting opening oriented towards a contact cutout in the center piece of the spring-force connection can also be provided in the bottom section of the bottom part, which is provided for receiving a PE connecting contact which has a spring-elastic contact tab and a plug-in contact arranged for electrical connection with the current rail of the spring-force connection in the contact cutout. This has the advantage that when three or more spring-force clamping connections are arranged in parallel with one another in a housing of insulating material, the PE contact is aligned with the contact pins which can be inserted into the contact cutout of the further spring-force connections such as, for example, the N and L conductor connection for an alternating-voltage supply. The PE connecting contact must be electrically connected to a protective conductor of the domestic voltage supply.

In a housing of insulating material, at least two spring-force connections aligned in parallel with one another are accommodated. For a 230 V alternating-voltage supply with N, L and PE (protective conductor) connections, for example, three spring-force connections are provided in parallel with one another in the housing of insulating material. However, conductor connecting terminals, for example with five spring-force connections arranged in parallel with one another, are also conceivable.

BRIEF DESCRIPTION OF THE DRAWINGS

In the text which follows, the invention will be explained in greater detail by means of an illustrative embodiment with the attached drawings, in which:

FIG. 12 shows a side view of lid part and spring-force connection in the assembly of the conductor connecting terminal from FIG. 8;

FIG. 13 shows a side view of a section of lid part with inserted spring-force connection and bottom part during the assembly;

DETAILED DESCRIPTION OF THE PREFERRED EMBODIMENT

Figure 1:
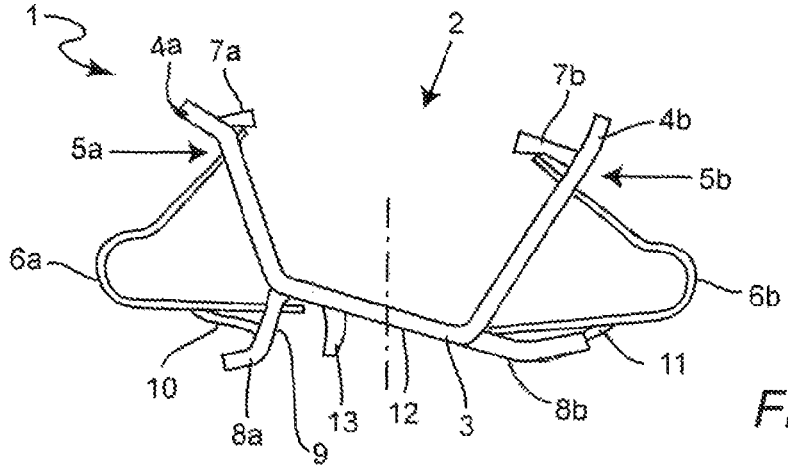
FIG. 1 shows a side view of a spring-force connection with inserted clamping springs.

FIG. 1 shows a spring-force connection 1 in a side view. The spring-force connection 1 has a current rail piece 2 of well-conducting material such as, for example, of copper or of a copper alloy. The current rail piece 2 formed from a strip of sheet metal has a center piece 3 which is adjoined on both sides by two end pieces 4*a*, 4*b* bent away from the center piece 3. The end pieces 4*a*, 4*b* point in the same direction so that the internal angle in the bending area between center piece 3 and end piece 4*a*, 4*b* is located on the same top of the rail piece.

In the end pieces 4*a*, 4*b*, conductor through-openings 5*a*, 5*b* are formed in a manner known per se by stamping out, into which clamping springs 6*a*, 6*b* of a spring material such as, for example, chromium-nickel-sheet steel are inserted. The clamping springs 6*a*, 6*b* have in a manner known per se a support leg and a clamping leg which are connected to one another via a spring arc.

In the upper end area of the end pieces 4*a*, 4*b*, material tabs 7*a*, 7*b* are stamped out of the current rail piece 2 and bent out of the conductor through-opening 5*a*, 5*b*, pointing towards one another. The end of the clamping legs of the clamping springs 6*a*, 6*b*, together with the material tabs 7*a*, 7*b* bent out, in each case forms a clamping point for a conductor end to be inserted into the conductor through-opening 5*a*, 5*b*. As an alternative, the material tabs 7*a*, 7*b* can also be placed pointing away from one another or pointing in the same direction. The orientation and construction of the material tabs 7*a*, 7*b* is dependent on the requirement for the position of the clamping point and other constructional parameters such as, for example, the kinematics of an operating pusher.

From the conductor through-openings 5*a*, 5*b*, support tabs 8*a*, 8*b* formed by stamping out of the current rail piece 2, which are bent out of the conductor through-opening 5*a*, 5*b* are also provided oppositely to the clamping points or the material tabs 7*a*, 7*b*. A conductor inserted into a conductor through-opening 5*a*, 5*b* is thus located between the associated clamping point and the associated support tabs 8*a*, 8*b* or, respectively, the adjoining center piece 3.

It can be seen that the support tab 8*a* on the left-hand side of the current rail piece 2 is bent out downward oppositely to the associated end piece 4*a*. In this support tab 8*a*, in turn, a through-opening 9 is introduced through which the end of the support leg of the clamping spring 6*a* is inserted. At the supporting leg of the clamping spring 6*a*, a contact tab 10 formed integrally with the clamping spring 6*a* is provided which goes away from the support leg and extends towards the end of the through-opening in the support tab 8*a* which is opposite the center piece 3 of the current rail piece 2. In this manner, a further clamping point is created below the support leg of the contact spring 6*a* which can be used, for example, for inserting a capacitor connecting tab or a PE connection.

On the right-hand side of the current rail piece, the support tab 8*b* is used for locking the support leg of the contact spring 6*b*. The end of the support leg of the contact spring 6*b* is supported, on the one hand, on the sill or indentation defined by the internal angle created by the support tab 8*b* and the end piece 4*b* bent away from the former towards the top. Furthermore, the support tab 8*b* is bent slightly upward with its end and is used with its end as seat for a locking tab 11 bent away from the support leg of the clamping spring 6*b*.

In the center of the center piece 3, a contact cutout 12 for inserting a contact pin is also formed in that a contact tab 13 is stamped out of the center piece 3 of the current rail piece 2 and is bent away downward. The contact tab 13 then forms a support area for a contact pin or contact plug inserted into the contact cutout 12. The left-hand side of the contact tab 13 is used as conductor stop for a conductor inserted from the left-hand side into a direct connection formed by the contact tab 10 and the support tab 8*a*.

Figure 2:
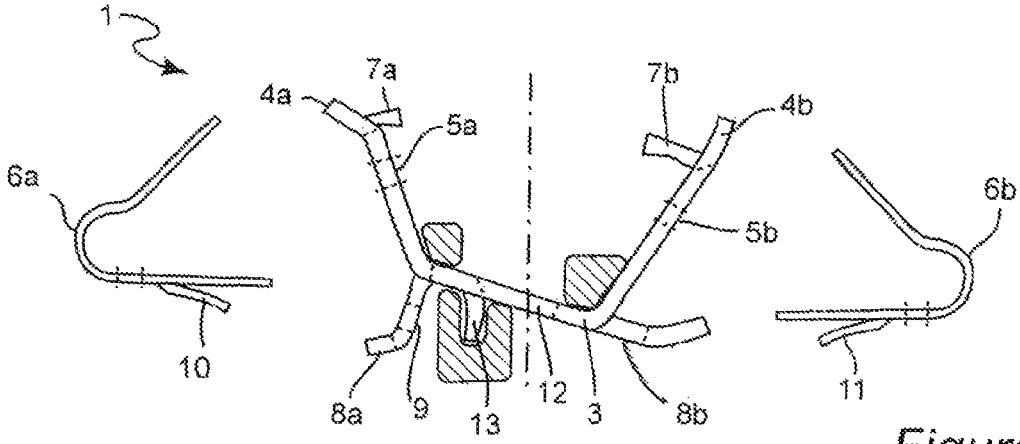
FIG. 2 shows an exploded view of the spring-force connection from FIG. 1 with clamping springs not inserted.

FIG. 2 shows the spring-force connection 1 from FIG. 1 in an exploded view. It can be clearly seen that the two clamping springs 6*a*, 6*b* extend over the through-openings 5*a*, 5*b* and are thus inserted pretensioned into these through-openings 5*a*, 5*b*.

Figure 3:
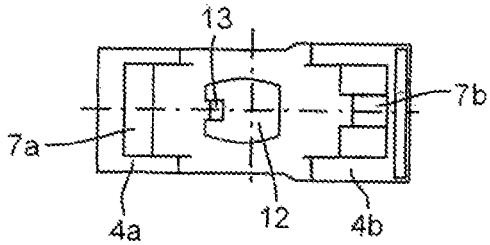
FIG. 3 shows a top view of the current rail piece from FIG. 2 from above.

FIG. 3 shows a top view of the current rail piece 2 from FIG. 2. This more clearly shows, in particular, the contact cutout formed in the center piece 3 with the contact tab 13 bent out downward and forming an additional conductor stop.

Figure 4:
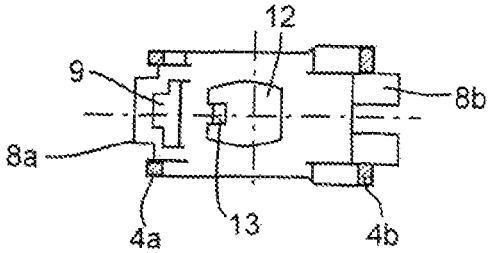
FIG. 4 shows a view of the current rail piece from FIG. 2 from below.

FIG. 4 shows a view of the current rail piece 2 from FIG. 2 from the bottom. In this arrangement, a possible embodiment of the support tab 8*b* on the right-hand side of the spring-force connection 1 becomes clearer. The support tab 8*b* has at its end in the center area an indentation for receiving the locking tab 11 bent away from the clamping spring 6*b*.

The support tab 8*a* on the left-hand side has a rectangular through-opening 9 with an also rectangular indentation at the end which, together with the contact tab 10 extending into this indentation forms a clamping point. Optionally, the indentation can also be slightly oblique, i.e. trapezoidal.

Figure 5:
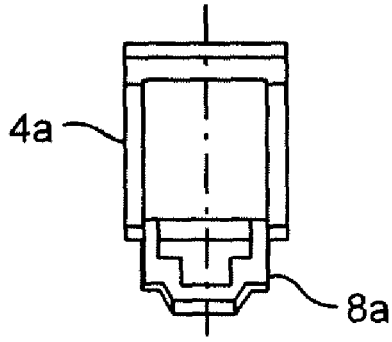
FIG. 5 shows a front view of the current rail piece from FIG. 2 from the left-hand side.

This embodiment of the support tab 8*a* on the left-hand side of the spring-force connection 1 becomes even clearer in the front view from FIG. 5.

Figure 6:
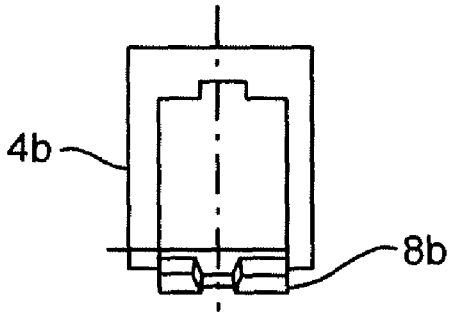
FIG. 6 shows a front view of the current rail piece from FIG. 2 from the right-hand side.

FIG. 6 shows the front view of the support tab 8*b* and the end piece 4*b* on the right-hand side of the spring-force connection 1 from FIG. 1.

Figure 7:
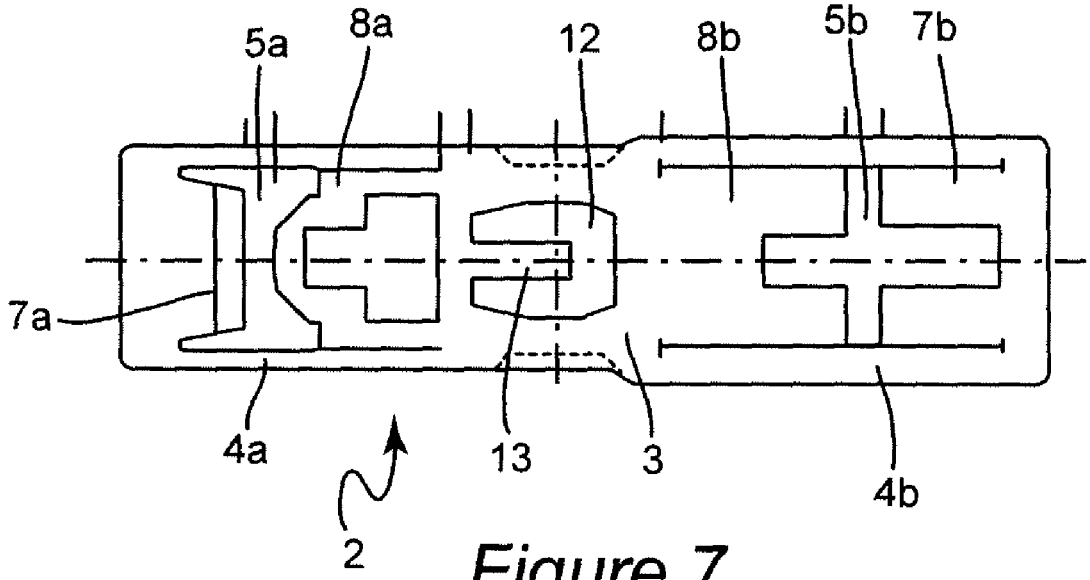
FIG. 7 shows a stamped sample of the unbent current rail piece of the spring-force connection from FIG. 1.

FIG. 7 shows the stamp sample of the current rail piece 2. It becomes clear that the through-openings 5*a*, 5*b* are formed by stamping pieces of material out of the current rail piece 2 which are bent out of the current rail piece 2.

Thus, from the left-hand side to the right-hand side, the material tab 7*a*, the support tab 8*a*, the contact tab 13, to be bent out towards the bottom, of the contact cutout 12, the support tab 8*b* for the second clamping spring 6*b* and the material tab 7*b* at the upper end of the right-hand end piece can be seen.

Figure 8:
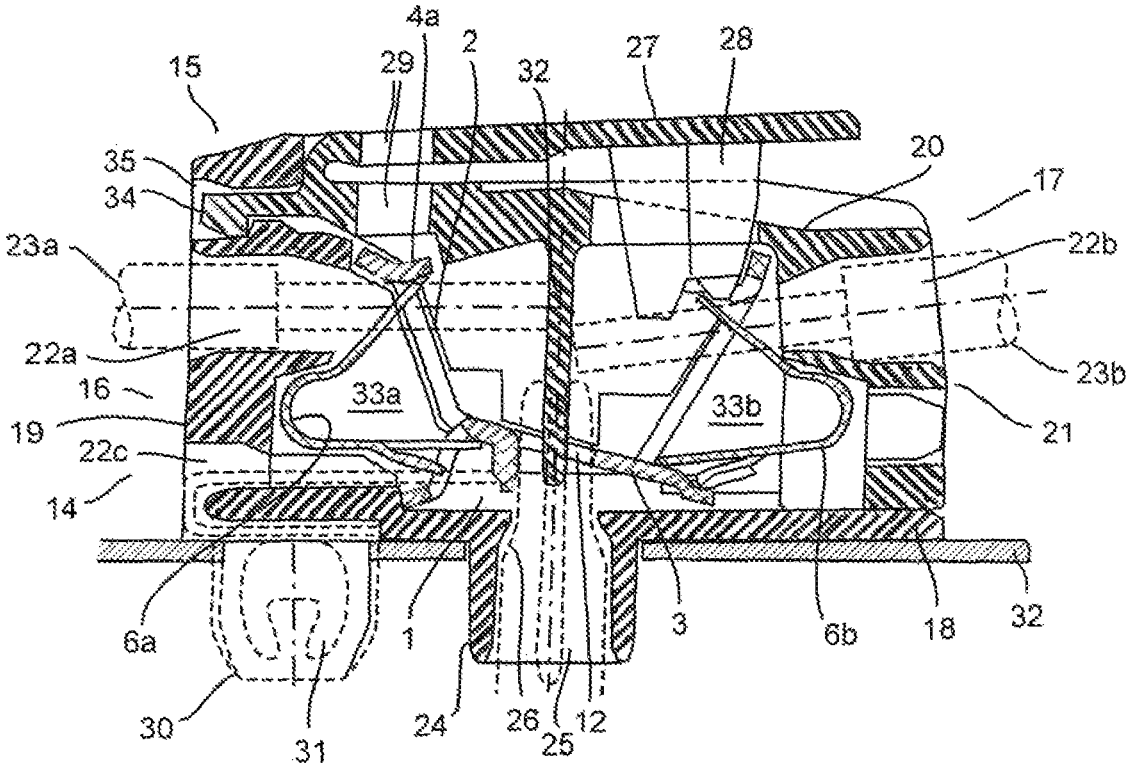
FIG. 8 shows a sectional view of a conductor connecting terminal with a spring-force connection inserted into a two-part housing of insulating material.

FIG. 8 shows a conductor connecting terminal 14 in a longitudinal sectional view through a housing 15 of insulating material. The housing 15 of insulating material is of two-part construction and has a bottom part 16 and a lid part 17 which are in each case L-shaped. The bottom part 16 is formed from a bottom section 18 and a front section 19 going upward at the end transversely thereto and the lid part 17 is formed from a lid section 20, closing off the housing 15 of insulating material, and a front section 21 going away downward at the end transversely thereto.

The spring-force connection 1 described above is inserted into the bottom part 16 in such a manner that the clamping points with conductor insertion openings 22*a*, 22*b* for conductor ends 23*a*, 23*b* to be inserted are essentially flush with one another (offset preferably of <10°).

From the bottom section 18, a terminal dome 24, which has a plug contact receiving duct 25 for receiving a contact pin or contact plug 26 can extend downward particularly in the embodiment shown of a three-pin lamp connecting terminal also for the current-conducting connections, i.e. the two outer connections. The plug contact receiving duct 25 is oriented towards the contact cutout 12 in the center piece 3 of the current rail 2.

It can also be seen that the lid section 20 has an operating pusher 27 formed integrally therewith and pivoted, for example, with a film hinge, with an operating finger 28 extending through the lid section 20, which rests on the end of the clamping leg of the second clamping spring 6*b* and displaces the latter towards the bottom when the operating pusher 27 is pushed in the direction of the lid section 20. In this manner, the through opening 5*b* is opened for inserting and removing a conductor end. It is optionally also conceivable that a separate lid is integrated in the locking area.

It can also be seen that on the left-hand side in the lid section 20 and the operating pusher 27, a test opening 29 is provided which is oriented towards the bent-over end of the left-hand end piece 4*a* of the current rail 2.

It is thus possible to check whether there is voltage potential at the current rail 2 with the aid of a voltage tester which is inserted through the test opening 29. This ensures the presence of the required leakage and air paths towards the contactable surface.

Below the left-hand conductor insertion opening 22*a*, adjoining the spring arc of the first clamping spring 6*a*, a further conductor insertion opening 22*c* is provided adjoining the wall of the bottom section 18 raised in this area, which is oriented towards the clamping point below the locating leg of the first clamping spring 6*a*.

Into this conductor insertion opening 22*c*, a PE connecting contact 30, drawn dashed, can be inserted, the connecting tab of which is inserted into the clamping point and which is folded over below the bottom section 18 and, with its clamp contact 31 downward, is provided for locking in and electrically contacting an equipment housing plate. When the PE connecting contact is plugged into the equipment housing plate 32, any coating and oxidation interfering with the electrical conductivity is eliminated due to the sharp-edge construction of the plug contact. The center contact connection to the contact pin 26 is not blocked by the PE connecting contact 30 located below the terminal. A compact construction can thus be achieved.

It can also be seen that from the lid section 20, a partition wall 32 is pointing downward in the direction of the terminal dome 24. Using this partition wall 32, the conductor receiving chambers 33*a*, 33*b* are separated from one another on both sides of the partition wall.

It can also be seen that the lid part 17 can be locked in a receptacle 35, having a projection, at the front of the bottom part 14 with the aid of a latch 34 having a nose. Lid part 17 and bottom part 14 are thus pushed together in the manner of a push-lock connection.

Figure 9:
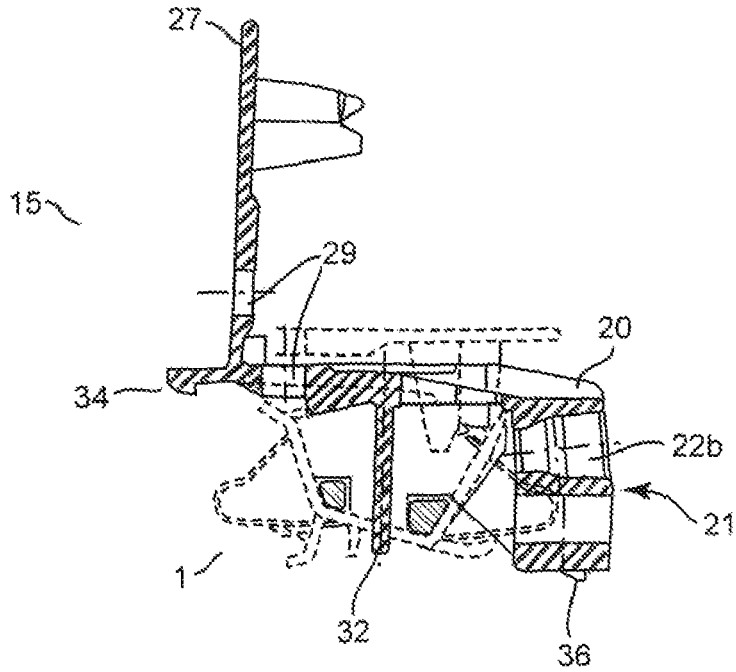
FIG. 9 shows a sectional view of the lid part of the housing of insulating material with spring-force connection inserted therein.

FIG. 9 shows a sectional view of the lid section 17 with operating pusher 27 in production position (or, respectively, in dashed form in delivery position). The locking nose latch 34 at the lid section 20 and a locking nose 36 at the lower edge of the front section for hooking into a corresponding receptacle in the bottom section 18 of the bottom part 14 can be clearly seen.

Figure 10:
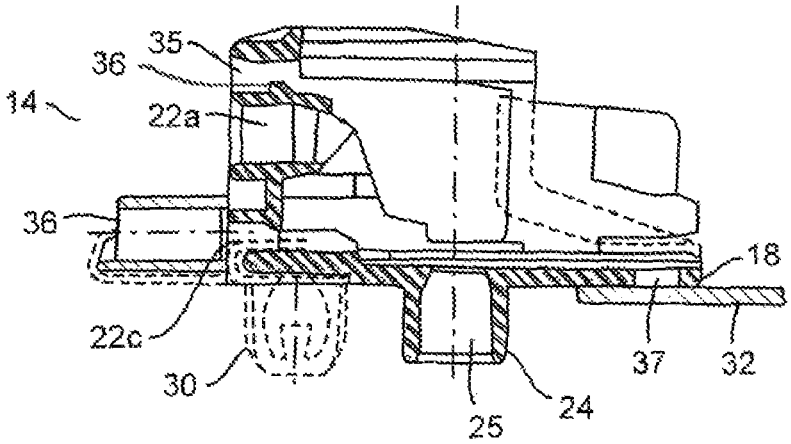
FIG. 10 shows a sectional view of the bottom part of the housing of insulating material of the conductor connecting terminal from FIG. 8.

FIG. 10 shows a sectional view of the bottom part 14 into which, apart from the dashed PE connecting contact 30, connecting tabs, for example of a capacitor 36, can be optionally inserted into the lower conductor insertion opening 22*c*.

A locking receptacle 37 for the locking nose 36 at the lower edge of the front section of the lid part 15 can also been seen.

Figure 11:
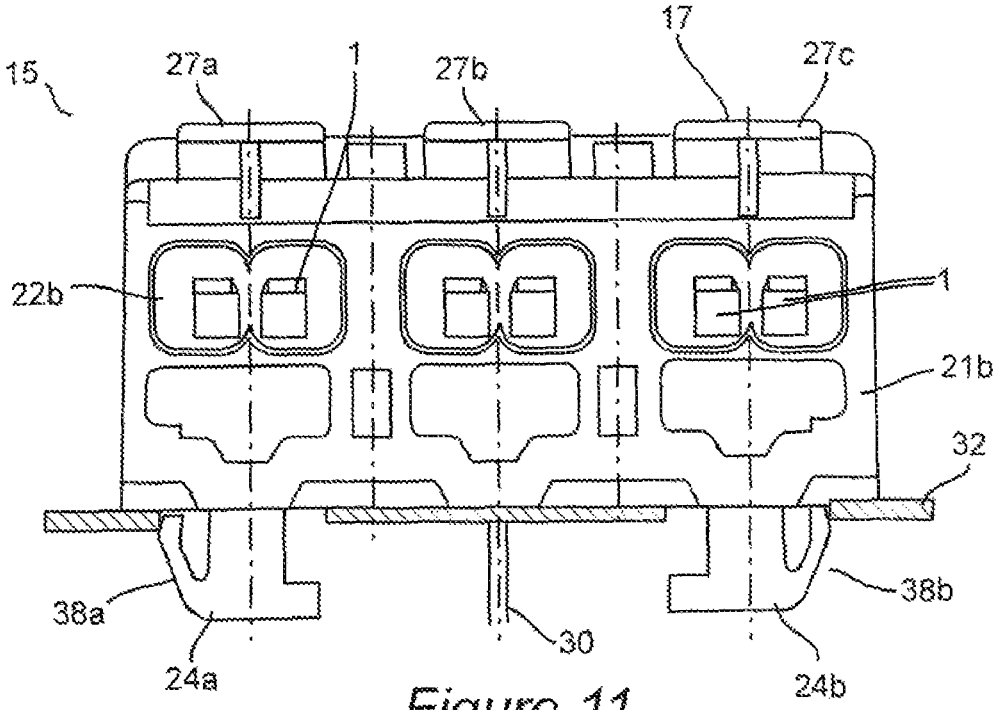
FIG. 11 shows a front view of the lid part of the housing of insulating material of the conductor terminal connection from FIG. 8.

FIG. 11 shows a front view of the conductor connecting terminal 15 from FIG. 8. The conductor connecting terminal is constructed with three pins for an N conductor, a L conductor and a protective conductor (PE) in the center and, for connecting the N and L conductors, has terminal domes 24*a*, 24*b*, protruding downward on the right- and left-hand side with spring locking noses 38*a*, 38*b*, protruding from these in a manner known per se, for locking the conductor connecting terminal 15 in an equipment housing plate 32.

In contrast, the PE connecting contact 30 protrudes downward without such a terminal dome 24 in order to make electrical contact with the equipment housing plate. The protective conductor does not require insulation by the terminal dome 24.

It can also be seen that for each connection, two conductor insertion openings 22*b* are provided next to one another, a separate spring-force connection 1 being allocated to each conductor insertion opening 22*b*. In this manner, several devices can be connected in series.

It can also be seen that a separate operating pusher 27*a*, 27*b*, 27*c* is provided for each connecting pin.

FIGS. 12 and 13 show more clearly in sectional views the assembly sequence of the conductor connecting terminal 15. Firstly, the clamping springs 6*a*, 6*b* are inserted into the corresponding conductor through-openings 5*a*, 5*b* of the current rail 2. The spring-force connection 1 finished in this way is then inserted into the lid part 17. For this purpose, the spring-force connection 1 is inserted into the lid section 17 by means of a handling machine containing a current rail support 37. As drawn in FIG. 13, the bottom part 14 is then pushed onto the lid part 17 and locked to it and the operating pusher 27 shown in the production position is folded over into the delivery or operating position shown dashed.

Figure 14:
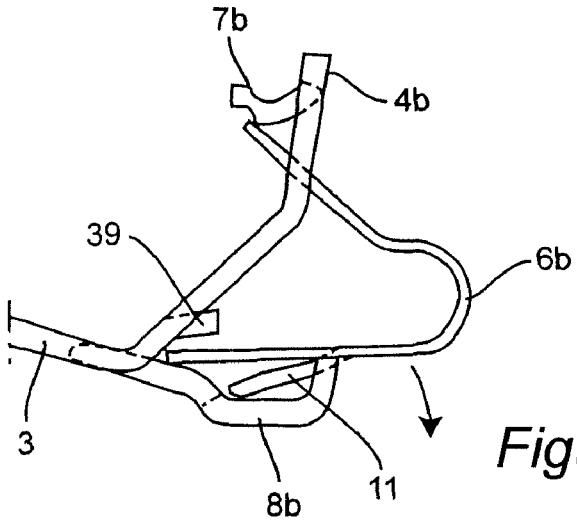
FIG. 14 shows a side view of an embodiment of a current rail piece with contact spring supported by a bent-over end of the support tab.

FIG. 14 shows another embodiment of the current rail piece 2 in which the free end of the support tab 8*b* is bent over upward in the direction of the locating leg of the clamping spring 6*b* in such a manner that the clamping spring 6*b* is supported by the support tab 8*b* when it is loaded and wants to move downward in the direction of the arrow. The locking tab 11 which may be present is located in an indentation formed by the end bent upward. Furthermore, the free end of the locating leg of the clamping spring 6*b* can be secured by a securing tab 39 going away from the current rail piece 2, which tab is located above the locating leg. In conjunction with the seating of the clamping spring 6*b* on the free end of the support tab 8*b*, this prevents the clamping spring 6*b* from tilting away.

Figure 15:
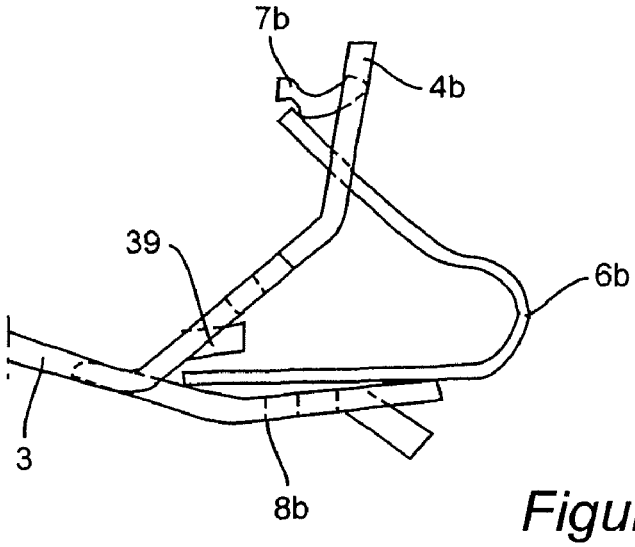
FIG. 15 shows a side view of an embodiment of a current rail piece with a contact spring resting on the end of the support tab.

FIG. 15 shows another embodiment of the current rail piece 2 in which the support tab 8*b* is slightly angled away upward with its free end in the direction of a transition area between locating leg and spring arc of the clamping spring 6*b*. As a result, the clamping spring 6*b* is supported very far at the back adjoining the spring arc when it is loaded in such a manner that the clamping spring 6*b* tends to tilt away downward.

Figure 16:
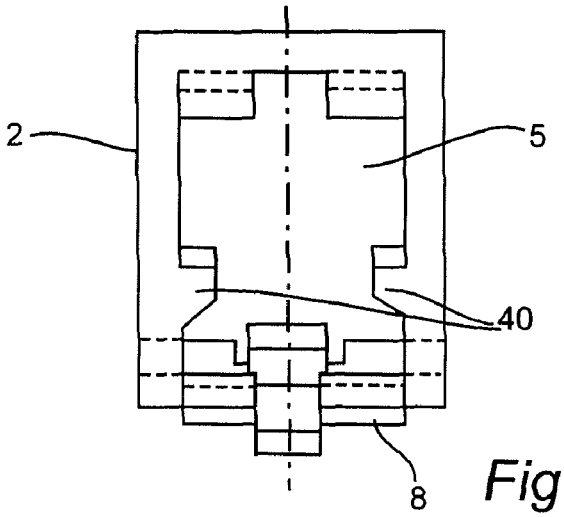
FIG. 16 shows a front view of a current rail piece in the area of a conductor through-opening with overload protection webs.

FIG. 16 shows an embodiment of the design of the conductor through-opening 5 in the current rail piece 2 in which excessive compression of a clamping spring 6 inserted into the conductor through-opening 5 is prevented by additional overload protection webs 40. The overload protection webs 40 project as noses at the two opposite side edges of the conductor through-opening 5.

The invention claimed is:

1. Spring-force electrical connection comprising:

a current rail piece having a top side and a facing down side with at least two mutually independent clamping points, each clamping point interacting-a spring end of an associated dedicated clamping spring for clamping electrical conductors, wherein each clamping spring is substantially U-shaped having two distinct free ends, wherein the current rail piece has on either side of a center piece first and second end pieces, each of said first and second end pieces bent away from the center piece and located opposite one another, an interior angle of which end pieces is located on the top side of the current rail piece in a bending area, wherein the first and second end pieces each have conductor through-openings into which associated dedicated clamping springs are inserted, and wherein the associated dedicated clamping springs are supported with one free end on the center piece of the current rail piece and, in the conductor-less inoperative state, rest with the other free end on a clamping point formed at the associated conductor through-opening, characterized in that the clamping points are arranged oppositely to one another so that a conductor inserted into a conductor through-opening is located between center piece and a corresponding clamping point.

2. Spring-force connection according to claim 1, characterized in that the clamping points in each case have a material tab, bent out of the conductor through-opening, of the current rail piece.

3. Spring-force connection according to claim 1, characterized by a contact cutout in the center piece of the current rail piece said contact cutout being designed to receive a contact pin coming into electrical contact with the current rail piece.

4. Spring-force connection according to claim 3, characterized in that the contact cutout has at least one side edge a contact tab bent out of the plane of the center piece and forming a conductor stop.

5. Spring-force connection according to claim 1, characterized in that at least one of the conductor through-openings has at an end of the conductor through-opening opposite to the clamping point a support tab bent out of the conductor through-opening.

6. Spring-force connection according to claim 5, characterized in that at least one of the clamping springs is supported with one clamping spring end and/or in the area of a support leg adjoining the clamping spring end, preferably in the area immediately adjoining a spring arc following the locating leg, on an associated support tab.

7. Spring-force connection according to claim 5, characterized in that the support tab has a sill or indentation and in that a support leg of at least one clamping spring comprising a contact tab bent away from the support leg, the end of which is supported at the sill or indentation whilst the clamping spring end not bent away rests on a seating area of the support tab adjoining the conductor through-opening.

8. Spring-force connection according to claim 5, characterized in that the support tab lies on a plane defined by the center piece of the current rail piece.

9. Spring-force connection according to claim 5, characterized in that a support tab is bent out of a plane of the center piece of the current rail piece oppositely to the end piece of the current rail piece adjoining the center piece and has a through-opening, wherein the clamping spring end of the associated clamping spring extends through the through-opening and is supported on the center piece.

10. Spring-force connection according to claim 9, characterized in that the clamping spring end extending through the through-opening has a contact tab, bent away from the clamping spring towards the end of the through-opening opposite to the center piece for electrically contacting a conductor end which can be pushed through the through-opening.

11. Conductor connecting terminal with a housing of insulating material and at least one spring-force electrical connection in the housing of insulating material, the spring-force connection comprising:

a current rail piece having a top side and a facing down side with at least two mutually independent clamping points, each clamping point interacting with one of two free ends of an associated dedicated clamping spring for clamping electrical conductors, wherein the current rail piece has on either side of a center piece first and second end pieces, each of said first and second end pieces bent away from the center piece and located opposite one another, an interior angle of which end pieces are located on the top side of the current rail piece in a bending area, wherein the first and second end pieces each have conductor through-openings into which associated dedicated clamping springs are inserted, and wherein the associated dedicated clamping springs are supported with one free end on the center piece of the current rail piece and, in a conductor-less inoperative state rest with the other free end on a clamping point formed at the associated conductor through-opening, characterized in that the clamping points are arranged oppositely to one another so that a conductor inserted into a conductor through-opening is located between the center piece and a corresponding clamping point, the conductor connecting terminal characterized in that the housing of insulating material comprises:

a bottom part and a lid part, which lid part can be locked into the bottom part by means of a push-lock connection, wherein said bottom part and said lid part are each formed as L-shaped sections which, when locked together, have opposing parallel long and short section to form a generally rectangular structure, the short section of the lid part having conductor insertion openings, and the opposing short section of the bottom part having conductor openings, which wherein the openings in the opposing short sections of the bottom part and the lid part are oriented towards the conductor through-openings at the end pieces of the spring-force connections inserted into the bottom part and fixed by the lid part.

12. Conductor connecting terminal according to claim 11, characterized in that at the end of the at least one conductor insertion opening there is an internal angle for receiving and for fixing one end of the current rail piece in the lid section of the lid part.

13. Conductor connecting terminal according to claim 11, characterized in that the lid section of the lid part has an operating pusher, formed pivotally at the lid section, with an operating finger extending through the lid section in the direction of the bottom section of the bottom part, which finger interacts with a clamping spring of the at least one spring-force connection when the operating pusher is pushed down in the direction of the bottom section of the bottom part for operating the clamping spring.

14. Conductor connecting terminal according to claim 11, characterized by a partition wall formed of insulating material integrally with the lid part, extending from the lid section in the direction of the bottom section at least to the center piece of the at least one spring-force connection, which wall delimits conductor receiving chambers adjoining the opposite conductor insertion openings in the housing of insulating material from one another.

15. Conductor connecting terminal according to claim 11, characterized in that in the transition of the front section of the bottom part in the bottom section, in each case a conductor insertion opening oriented towards a clamping point formed below a clamping spring of the spring-force connection is provided and the bottom section is raised in the direction of the lid part in the area of the conductor insertion opening, so that a PE connecting contact can be electrically connected to a spring-force connection through the conductor insertion opening and, after a bend below the bottom section, can be arranged so as to protrude for connection to an equipment housing.

16. Conductor connecting terminal according to claim 11, characterized by at least one terminal dome protruding from the bottom section, with in each case a plug contact receiving duct oriented towards an associated contact cutout with center piece of the spring-force connection.

17. Conductor connecting terminal according to claim 11, characterized by terminal domes on the underside of the bottom section with spring locking noses for locking the conductor connecting terminal to an equipment housing plate.

18. Conductor connecting terminal according to claim 11, characterized by a PE connecting opening, oriented towards a contact cutout in the center piece of the spring-force connection, in the bottom section of the bottom part for receiving a PE connecting contact having a contact tab and a plug contact designed for the electrical connection to the current rail of the spring-force connection in the contact cutout.

19. Conductor connecting terminal (14) according to claim 11, characterized in that at least three spring-force connections aligned in parallel with one another are accommodated in the housing of insulating material.

* * * * *